US008774700B2

(12) United States Patent
Shikama et al.

(10) Patent No.: US 8,774,700 B2
(45) Date of Patent: Jul. 8, 2014

(54) IMAGE PROCESSING APPARATUS, AN IMAGE FORMING APPARATUS, AN IMAGE PROCESSING METHOD AND A RECORDING MEDIUM

(75) Inventors: Takeshi Shikama, Osaka (JP); Tatsuya Miyadera, Osaka (JP); Izumi Kinoshita, Hyogo (JP); Kunihiro Komai, Osaka (JP); Yoshinori Shirasaki, Osaka (JP); Akinori Yamaguchi, Kanagawa (JP); Takuhei Yokoyama, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 160 days.

(21) Appl. No.: 13/224,843

(22) Filed: Sep. 2, 2011

(65) Prior Publication Data

US 2012/0061909 A1 Mar. 15, 2012

(30) Foreign Application Priority Data

Sep. 15, 2010 (JP) ..... 2010-206788

(51) Int. Cl.
*G03G 15/00* (2006.01)

(52) U.S. Cl.
USPC ..... 399/395; 271/227

(58) Field of Classification Search
USPC ..... 271/226–228; 399/301, 394, 395
See application file for complete search history.

(56) References Cited

U.S. PATENT DOCUMENTS

2010/0119273 A1 * 5/2010 Komai et al. ..... 399/395

FOREIGN PATENT DOCUMENTS

| | | | |
|---|---|---|---|
| JP | 04-189239 | | 7/1992 |
| JP | 2000-086017 | | 3/2000 |
| JP | 2008-46488 | * | 2/2008 |

* cited by examiner

*Primary Examiner* — Thomas Morrison
(74) *Attorney, Agent, or Firm* — IPUSA, PLLC

(57) ABSTRACT

An image processing apparatus includes a reading part configured to optically read skew amount measurement patterns and opposite ends of a paper sheet; an image skew amount detecting part configured to detect skew amounts on a color basis based on the skew amount measurement patterns; a paper sheet skew amount detecting part configured to detect a skew amount of the paper sheet based on a displacement between the opposite ends of the paper sheet; a skew correction amount calculating part configured to calculate skew correction amounts of the respective colors based on the skew amounts; and a skew correcting part configured to shift the images to correct the skews by recording input image data in plural lines of a line memory, dividing the input image data into plural areas in a main scanning direction, and setting line delay amounts on an area basis based on the skew correction amounts.

10 Claims, 9 Drawing Sheets

IMAGE PROCESSING APPARATUS, AN IMAGE FORMING APPARATUS, AN IMAGE PROCESSING METHOD AND A RECORDING MEDIUM

FIELD

The present invention is related to an image processing apparatus, an image forming apparatus, an image processing method and a recording medium for a skew correction.

BACKGROUND

In the field of color image forming apparatuses, a technique for registration between the respective colors is important. Misregistration may occur due to misregistrations and distortions of f-theta lenses or reflective mirrors in the case of LD (Laser Diode) raster systems, and distortions and installation errors of LEDA heads in the case of LEDA (Light Emitting Diode Array) writing. With respect to misregistrations with a bending and a skew in a sub-scanning direction, among misregistrations, there are a mechanical correcting way and a correcting way based on the image processing. According to the mechanical correcting way, the correction is implemented by providing an adjustment mechanism for displacing the mirror in the writing unit. An actuator such as a motor is utilized to automate the adjustment.

According to the correcting way based on the image processing, parts of the image data are accumulated in a line memory, and the lines of the line memory from which the data is to be read are switched according to the writing positions, thereby shifting the image in the sub-scanning direction and thus correcting the skew between colors. In this case, it is known that the skew may be preferably reduced by adding a line memory in the image processing part according to a range to be corrected.

The way of reducing the skew is known from Patent Document 1, for example. Patent Document 1 discloses a method of correcting an offset and a skew in a printer device which includes a detecting part configured to detect a status of a paper sheet supplied between a waiting roller for supplying the paper sheet and a photosensitive drum; and a controlling part configured to receive the detection signal from the detecting part, perform the correction and output a control signal of an optical system and a driving signal of a motor for adjustment of the optical system. According to the method disclosed in Patent Document 1, a print start position and print start timing are corrected based on an offset which is detected based on the detection signal from the detecting part, a skew angle is calculated based on the detection signal, and the position of the optical system is adjusted such that the skew angle is corrected.

[Patent Document 1] Japanese Laid-open Patent Publication No. 04-189239

However, with the correcting method according to the related art, even if the skew amounts between the colors are corrected, there is a problem that the start positions of writing of the image are not parallel with a horizontal (main) scanning direction if the paper sheet is skewed. Further, with a line memory control for the skew correction, there is a problem that the lack of the capacity of the line memory may occur, and thus the correction method not be performed correctly when the correction of the skew amounts between colors and the correction of skew between the paper sheet and the image are performed in combination.

The configuration disclosed in Patent Document 1 cannot solve these problems.

An object of the present invention is to reduce the skew amount between the paper sheet and the image even with the line memory.

SUMMARY

According to an aspect of the embodiment, an image processing apparatus for a skew correction is provided. The image processing apparatus for the skew correction includes a reading part configured to optically read skew amount measurement patterns and opposite ends of a paper sheet; an image skew amount detecting part configured to detect a skew amount on a color basis based on the skew amount measurement patterns read by the reading part; a paper sheet skew amount detecting part configured to detect a skew amount of the paper sheet based on a displacement between the opposite ends of the paper sheet read by the reading part; a skew correction amount calculating part configured to calculate skew correction amounts of the respective colors based on the skew amounts detected by the image skew amount detecting part and the paper sheet skew amount detecting part; and a skew correcting part configured to shift the images to correct the skews by recording input image data in plural lines of a line memory, dividing the input image data into plural areas in a main scanning direction, and setting line delay amounts on an area basis based on the skew correction amounts calculated by the skew correction amount calculating part.

DESCRIPTION OF EMBODIMENTS

The present disclosure is related to skew correction control using a line memory in which a reference line for the skew correction is changed or capacities of the line memory for the respective colors are changed, thereby enabling the skew correction without increasing the overall capacity of the line memory.

In the following, embodiments will be described by referring to the accompanying drawings.

Figure 1:
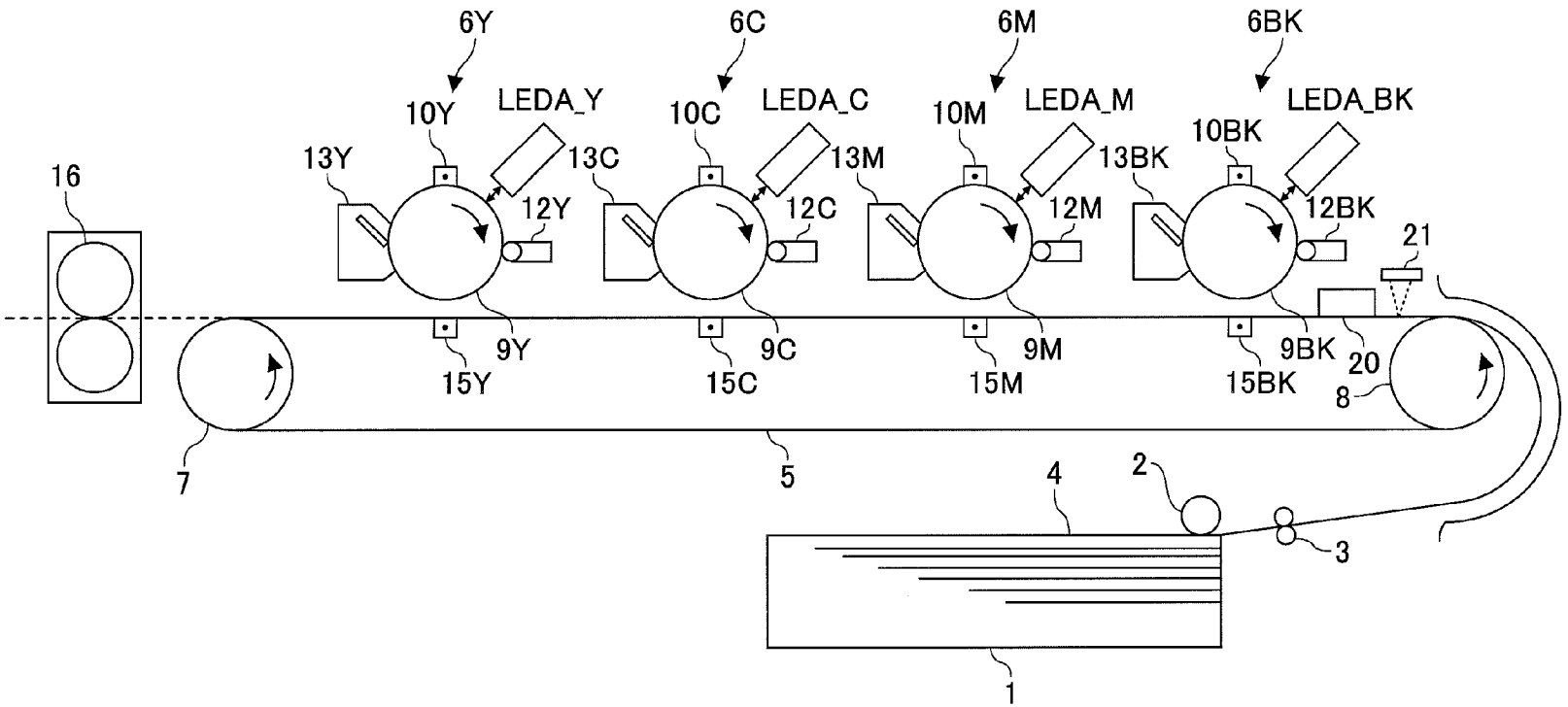
FIG. 1 is a drawing illustrating an example of an overall configuration of an image forming part of an image forming apparatus according to an embodiment wherein the image forming part is configured to form images with a direct transfer method.
Figure 2:
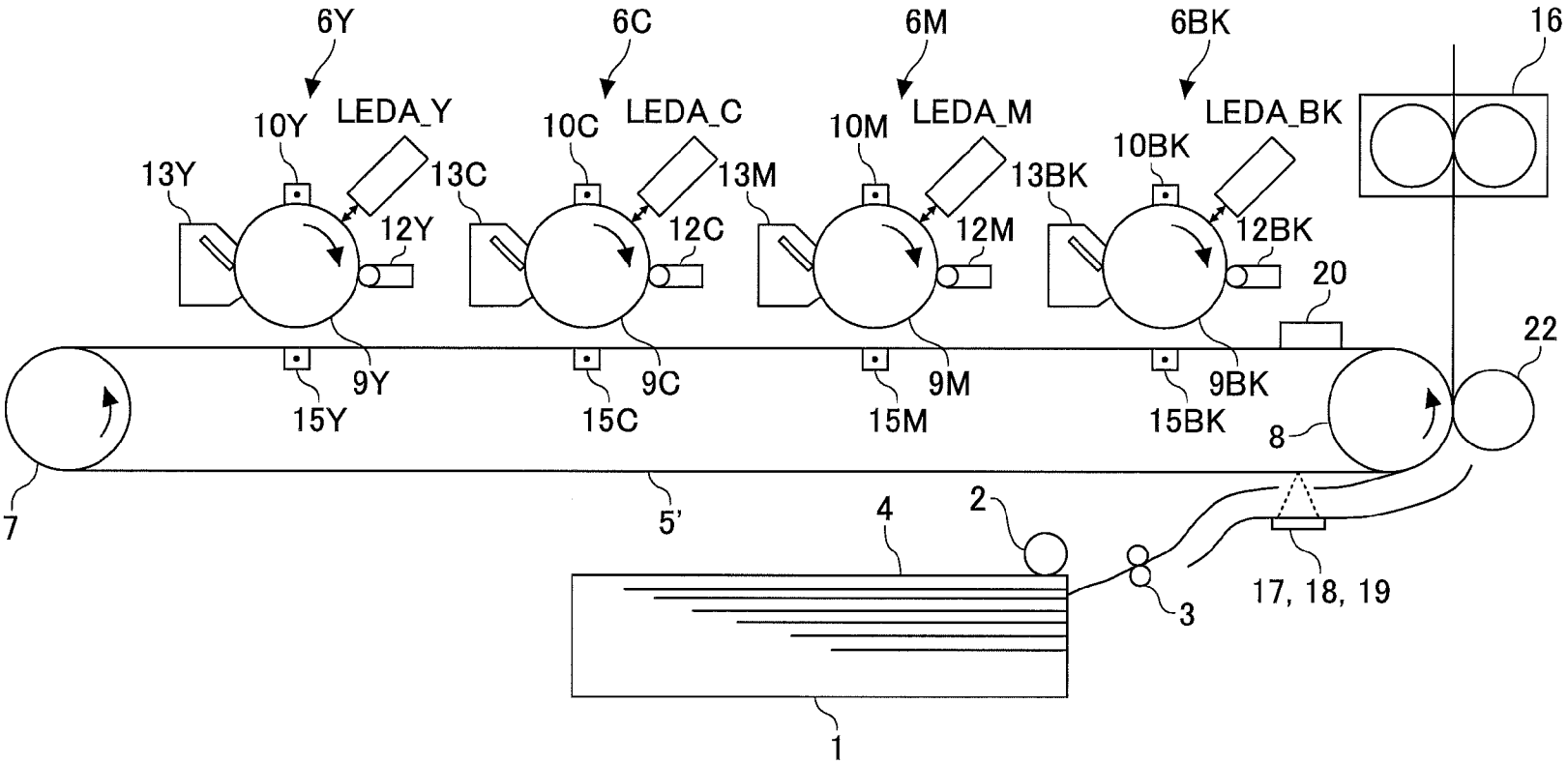
FIG. 2 is a drawing illustrating an example of an overall configuration of an image forming part of an image forming apparatus according to an embodiment wherein the image forming part is configured to form images with an indirect transfer method.

FIGS. 1 and 2 are drawings illustrating examples of an overall configuration of an image forming part (a printer part) of an electrophotographic image forming apparatus having LEDA heads. FIG. 1 illustrates a tandem type and direct transfer type image forming apparatus in which a sheet-like recording medium (referred to as "a paper sheet", hereinafter) such as a paper sheet, a transfer paper, a recording paper, a film-like element, etc., is held and conveyed on a conveyer belt, and a full color image is formed on the paper sheet by superimposing toner of the respective colors of KMCY. FIG. 2 illustrates a tandem type and indirect transfer type image forming apparatus in which a full color image is formed on an intermediate transfer belt by superimposing toner of the respective colors of KMCY and the full color image is transferred to the paper sheet.

In FIG. 1, the tandem type and direct transfer type image forming apparatus according to the embodiment has a configuration in which image forming parts for the respective colors are arranged along a conveyer belt 5 which is an endless conveying part. Specifically, image forming parts (electrophotographic process parts) 6BK, 6M, 6C and 6Y are arranged in this order from the upstream side in a conveying direction of the conveyer belt 5 along the conveyer belt 5 which conveys paper sheets 4 separated to be fed from a paper feeding tray 1 by a paper feeding roller 2 and a separating roller 3. These image forming parts 6BK, 6M, 6C and 6Y have the same internal configuration, and form toner images whose colors are different. The image forming part 6BK forms a black image, the image forming part 6M forms a magenta image, the image forming part 6C forms a cyan image and the image forming part 6Y forms a yellow image. Thus, in the following, the image forming part 6BK is described specifically since other image forming parts 6M, 6C and 6Y are substantially the same as the image forming part 6BK. The components of the image forming parts 6M, 6C and 6Y are given the symbols M, C and Y instead of the symbol BK attached to the corresponding components and the explanation is omitted.

The conveyer belt 5 includes an endless belt which is wound around a drive roller 7, which is driven to rotate, and a driven roller 8. The drive roller 7 is driven to rotate by a drive motor (not illustrated). The drive motor, the drive roller 7 and the driven roller 8 function as a drive part for moving the conveyer belt 5. In order to form the image, the uppermost paper sheet 4 stored in the paper feeding tray 1 is fed, held on the conveyer belt 5 by electrostatic attraction, conveyed to the first image forming part 6BK by the conveyer belt 5 driven to rotate, and at the first image forming part 6BK the black toner image is transferred. The image forming part 6BK includes a photosensitive drum 9BK as a photosensitive element; a charging unit 10BK disposed around the photosensitive drum 9BK, a LEDA head LEDA_BK; a developing unit 12BK; a photosensitive cleaning unit 13BK; a static eliminator (not illustrated), etc. The LEDA head LEDA_BK is configured to expose the photosensitive drum 9BK in the image forming part 6BK.

In order to form the image, the outer surface of the photosensitive drum 9BK is charged uniformly by the charging unit 10BK under low light conditions, and is exposed to a light corresponding the black image radiated from the LEDA head LEDA_BK to form an electrostatic latent image. The developing unit 12BK visualizes the electrostatic latent image with the black toner, thereby forming the black toner image on the photosensitive drum 9BK.

The toner image is transferred onto the paper sheet 4 by the action of a transferring unit 15BK at the location (transfer point) where the photosensitive drum 9BK comes into contact with the paper sheet 4 on the conveyer belt 5. As a result of this transfer, the image of the black toner BK is formed on the paper sheet 4. The photosensitive drum 9BK, which has finished transferring the toner image, is cleared of unnecessary toner remaining on the outer surface by the photosensitive cleaning unit 13BK, has the charge removed by the static eliminator to wait for the next formation of an image.

The paper sheet 4 on which the toner image of black BK is thus formed at the image forming part 6BK is conveyed to the next image forming part 6M by means of the conveyer belt 5. In the image forming part 6M, with the same image-forming process as in the image forming part 6BK, a toner image of magenta M is formed on the photosensitive drum 9M, and the toner image is transferred on the paper sheet 4 such that it is superimposed on the image of black BK formed on the paper sheet 4. The paper sheet 4 is further conveyed to the next image forming parts 6C and 6Y, and with the same operations, a toner image of cyan C formed on the photosensitive drum 9C and a toner image of yellow Y formed on the photosensitive drum 9Y are transferred and superimposed on the paper sheet 4. In this way, a full color image is formed on the paper sheet 4. The paper sheet 4 on which the full color superimposed image is formed is released from the conveyer belt 5 to fuse the image with a fuser 16, and then ejected out of the image forming apparatus.

When patterns for detecting misregistration are rendered on the belt, the image generating system is used to write patterns of the respective colors on the conveyer belt 5. The pattern of each of four colors is rendered, and amounts of displacements between the patterns of the respective colors are detected by a reflective sensor 21. The reflective sensor 21 is disposed upstream of the image forming part 6BK which is disposed at the most upstream location among the image forming parts.

During the detection of the patterns, the toner of the patterns which has been detected is recovered by a cleaning mechanism 20. The cleaning mechanism 20 includes a mechanism to be spaced apart from the conveyer belt 5. The cleaning mechanism 20 comes into contact with the conveyer belt 5 only at the time of cleaning. The cleaning mechanism 20 is disposed between the image forming part 6BK, which is disposed at the most upstream location among the image forming parts, and the reflective sensor 21, which is disposed upstream of the image forming part 6BK. The conveyer belt 5 has a skew detection line in a direction perpendicular to a conveying direction, and a belt reference line in a lateral direction can be detected based on the skew detection line detected by the reflective sensor 21.

At the time of printing, the paper feeding roller 2 is rotated to convey the paper sheet 4 from the tray 1. At the time of conveying the paper sheet 4, positions of the opposite ends of the paper sheet 4 are detected when the paper sheet 4 passes through the sensor 21 to detect a skew amount of the paper sheet 4 itself.

In FIG. 2, the tandem type and indirect transfer type image forming apparatus according to the embodiment has an intermediate transfer belt 5' instead of the conveyer belt 5 in FIG. 1, and is configured to transfer the color image, which is formed on the intermediate transfer belt 5' by superposing images of four colors, is transferred onto the paper sheet 4 in one action. The intermediate transfer belt 5' includes an endless belt which is wound around a drive roller 7, which is driven to rotate, and a driven roller 8. The toner images of the respective colors are transferred onto the intermediate transfer belt 5' by the actions of transferring units 15BK, 15M, 15C and 15Y at the locations (primary transfer point) where the photosensitive drums 9BK, 9M, 9C and 9Y, respectively, come into contact with the intermediate transfer belt 5'. As a result of this transfer, the full color image formed from the superposed images of the respective colors is formed on the intermediate transfer belt 5'. In order to form the image, the uppermost paper sheet 4 stored in the paper feeding tray 1 is fed, conveyed on the intermediate transfer belt 5', and the full color image is transferred thereon at a nip (second transfer point) where the paper sheets 4 comes into contact with the intermediate transfer belt 5'. A secondary transferring roller 22 is disposed at the nip. The secondary transferring roller 22 presses the paper sheet 4 against the intermediate transfer belt 5', thereby improving transfer efficiency. The secondary transferring roller 22 stays in close contact with the intermediate transfer belt 5' and does not include a mechanism for selectively separating from the intermediate transfer belt 5'.

With respect to differences between the tandem type and direct transfer type image forming apparatus illustrated in FIG. 1 and the tandem type and indirect transfer type image forming apparatus illustrated in FIG. 2, in the case of the former, a primary transfer medium is the paper sheet 4 and the full color image is formed at the primary transfer, while in the case of the latter, a primary transfer medium is the intermediate transfer belt 5', the image on the intermediate transfer belt 5' is secondarily transferred to the paper sheet 4 after the full color image has been formed on the intermediate transfer belt 5'. The other components may be the same between the tandem type and direct transfer type image forming apparatus illustrated in FIG. 1 and the tandem type and indirect transfer type image forming apparatus illustrated in FIG. 2. It is noted that the reference numeral 20 indicates a cleaning mechanism for removing the toner remaining on the paper sheet 4 after the first transfer to the intermediate transfer belt 5' and the secondary transfer to the paper sheet 4.

Reflective sensors 17 and 19 may be provided in a path where the conveying path and the intermediate transfer belt 5' are overlapped. The sensors 17 and 19 are used as color displacement detecting sensors when the amounts of the displacements between the respective colors are to be detected with color displacement patterns, and are used as skew detecting sensors when the skew amount at the leading edge of the paper sheet at the time of printing is to be detected. It is noted that a sensor 18 is a reflective sensor for detecting the color displacement only, and is provided such that it is opposed to a center portion in the conveying direction of the paper sheet 4.

Figure 3:
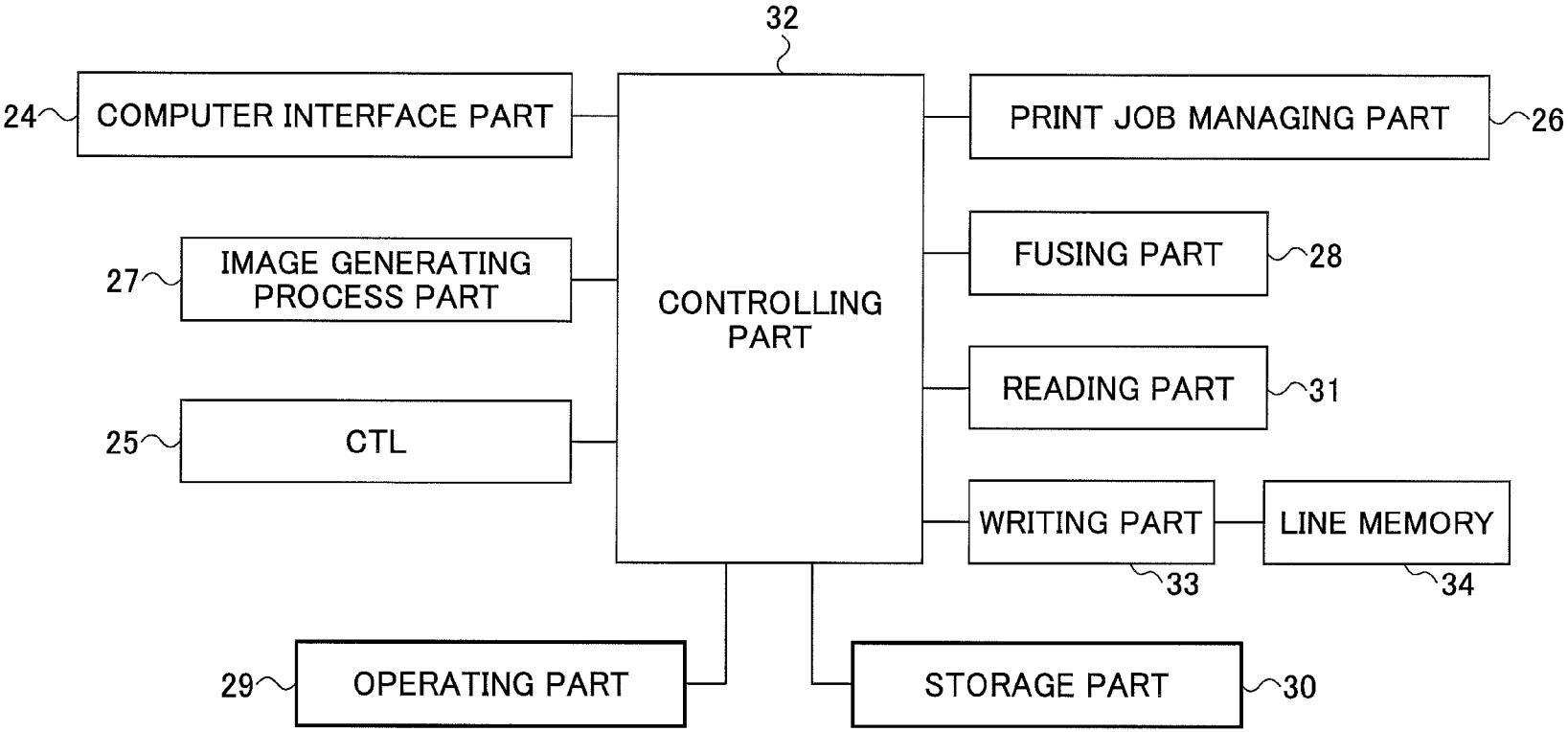
FIG. 3 is a functional block diagram illustrating a schematic configuration of the image forming apparatuses illustrated in FIGS. 1 and 2.

FIG. 3 is a functional block diagram illustrating a schematic configuration of the image forming apparatus.

The image forming apparatus includes a computer interface part 24, an image generating process part 27, a CTL (controller) 25, a print job managing part 26, a fusing part 28, a reading part 31, a writing part 33, an operating part 29 and a storage part 30, which are connected to a controlling part 32 such that they can communicate with the controlling part 32. The writing part 33 is connected to a line memory 34.

The computer interface part 24 performs communications with a terminal device (PC: Personal Computer) which issues a print demand to the image forming apparatus. The CTL 25 transmits image data transmitted from the terminal device to the image forming apparatus. The print job managing part 26 manages the order in which the printing operations are performed with respect to the print jobs demanded of the image forming apparatus. The image generating process part 27 generates toner images with the image forming apparatus illustrated in FIG. 1 or 2 based on the image information stored in an image memory part, and transfers the toner images to the paper sheets. In the case of detecting the misregistration at the time of printing, the image generating process part 27 correct the misregistration. The fusing part 28 applies heat and pressure to the paper sheet to fuse the toner image transferred by the image generating process part 27. The operating part 29 is a user interface for displaying a status of the image forming apparatus and receiving inputs to the image forming apparatus. The storage part 30 stores the status of the image forming apparatus at a certain point in time. The reading part 31 optically reads the printed information on the paper sheet to convert it to an electric signal. The writing part 33 converts the image data transmitted from the CTL 25 to a signal for activating an LED of the LEDA head to turn on the LED. It is noted that in the case of the head using an LD, the writing part 33 converts the image data to a signal for activating and turning on the laser. The line memory 34 stores the data transmitted from the CTL 25 in a temporary buffer to adjust the skew amount by the image processing. The controlling part 32 controls the image forming apparatus as a whole and controls a series of operations of the respective parts described above.

Figure 4:
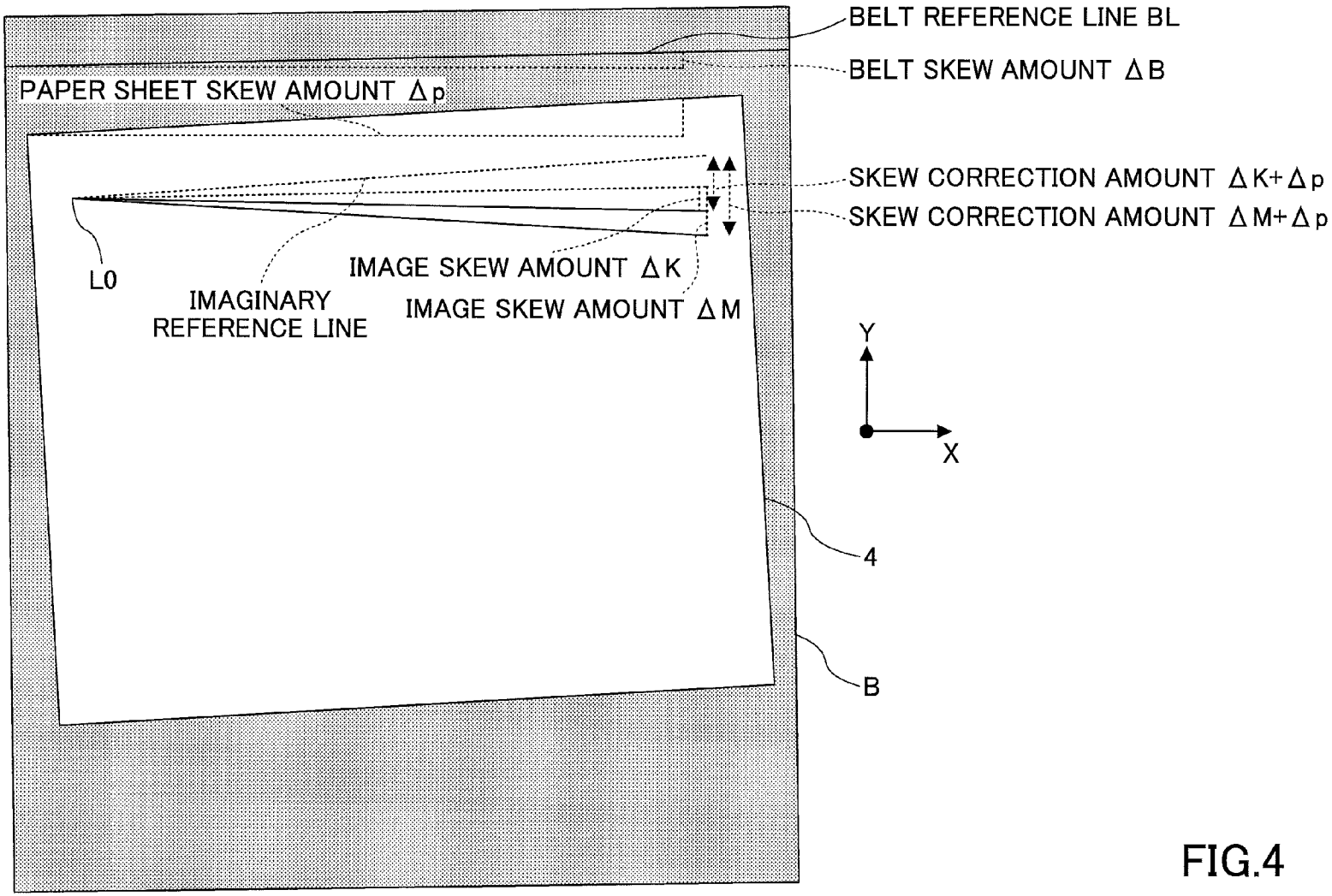
FIG. 4 is a drawing for explaining an example of skew correction control.

FIG. 4 is a drawing for explaining an example of skew correction control.

The skew is detected based on positional information of the opposite ends of the paper sheet in the main scanning direction (X direction) perpendicular to the conveying direction Y of the paper sheet 4. At that time, the skew detection patterns (not illustrated) are rendered at the opposite ends of a belt B (including the conveyer belt 5 and the intermediate transfer belt 5'), and the skew is detected based on the timings when the patterns at the opposite ends pass the sensors (the sensor 21 in FIG. 1 and sensors 17 and 19 in FIG. 2). If the timings of the detections at the opposite ends are the same, it means that there is no skew. On the other hand, if the timings of the detections at the opposite ends are shifted, it means that there is skew and thus the image is rendered in an inclined manner.

The detection method described above is related to a way of detecting the skew with respect to the image; however, the skew ΔB of the belt and the skew Δp are detected based on the detection timings of the patterns at the opposite ends in the main scanning direction.

Image skew amounts of the respective colors are calculated with respect to an imaginary reference line. The imaginary reference line includes a reference line L on which the skew amount of the paper sheet is reflected, and a reference line BL on which the skew amount of the belt is reflected. The skew amounts are calculated based on differentials between these reference lines and the respective color images.

Specifically, the imaginary reference line L is determined based on the skew amount of the paper sheet 4, and the skews of the respective colors with respect to the imaginary reference line L are corrected. If the left end L0 is used as a reference for skew calculation, correction amounts of the respective colors are calculated based on the following equations.

$$\text{Paper sheet correction amount } K=\Delta p+\Delta K \quad (1)$$

$$\text{Paper sheet correction amount } M=\Delta p+\Delta M \quad (2)$$

$$\text{Belt correction amount } Kb=\Delta B+\Delta K \quad (3)$$

$$\text{Belt correction amount } Mb=\Delta B+\Delta M \quad (4)$$

Where Δp is the skew amount of the paper sheet 4, ΔB is a correction amount of the belt B, ΔK is a skew amount of the black color, and ΔM is a skew amount of the magenta color. Since the correction amounts K, M, Kb and Mb of the black and magenta colors are adapted to the paper sheet 4 or the belt B, it is possible to perform corrections according to the paper sheet 4.

However, the capacity of the line memory 4 is limited. Thus, if the correction amounts K and M of the black and magenta colors are greater than an upper limit of the amount which can be delayed at the line memory 4, the adjustment of the correction amounts and the sharing of the line memory 4 are performed according to the skewed patterns.

Figure 5:
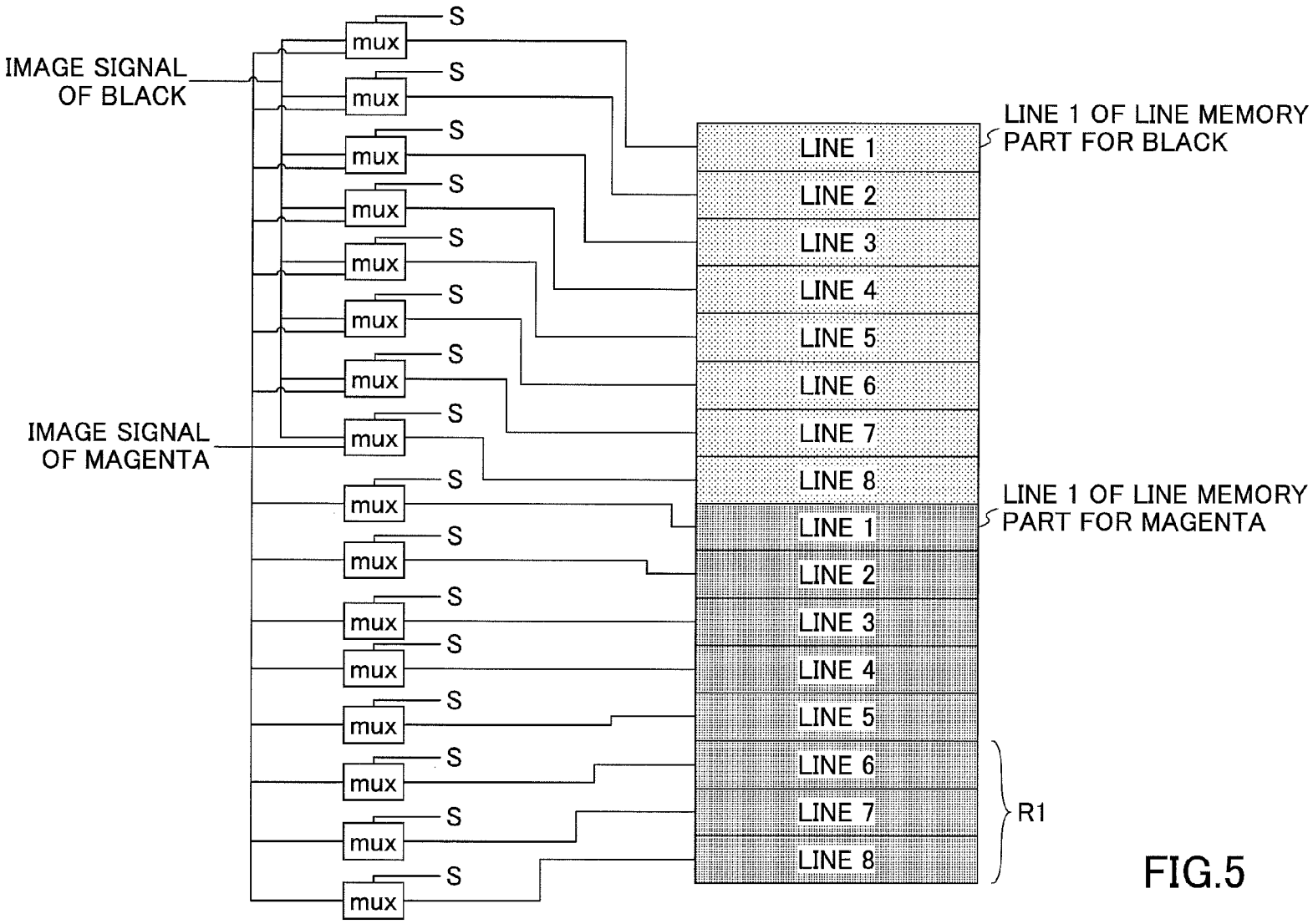
FIG. 5 is a drawing for explaining an example of a shared circuit of a line memory.

FIG. 5 is a drawing for explaining an example of skew correction control.

The sharing process includes sharing unused lines with colors if the line memory capacities allocated to the respective colors become insufficient with respect to the skew correction amounts. With this arrangement, it is possible to perform the skew corrections with a reduced capacity of the memory.

The illustrated example has a line memory configuration of the two colors of black and magenta. The line memory 34 includes eight lines for each color. One multiplexer (mux) is provided for each line (LINEs 1-8).

When the image signals of the respective colors are input, the multiplexers of the respective lines (LINEs 1-8) determine from which line the image data is output. If there is no need for sharing control of the line memory, the same capacities of the line memory are allocated to the respective colors and the lines in which the data is to be stored are designated by the signals S of the multiplexers (muxs).

If the line memory 34 is shared, the calculation of the sharing amount of the line memory and the allocation of the areas are performed by the controlling part 32. For example, if it is calculated that the line memory capacity required for the correction of the black color is ten lines and the line memory capacity required for the correction of the magenta color is five lines, the line memory capacity for the black color requires two more lines and the line memory capacity for the magenta color has three free lines. The controlling part 32 specifies a starting address of the free lines and the sharing capacity. If these two lines of the line memory allocated to the magenta color are shared with the black color, the control signals of the multiplexers associated with the region R1 from the line 6 to the line 8 of the magenta color are changed such that the control signals of the black color are output. With this arrangement, the line memory capacity of the black color is increased by the three lines and thus the lack of the capacity of the two lines can be compensated for.

Figure 6:
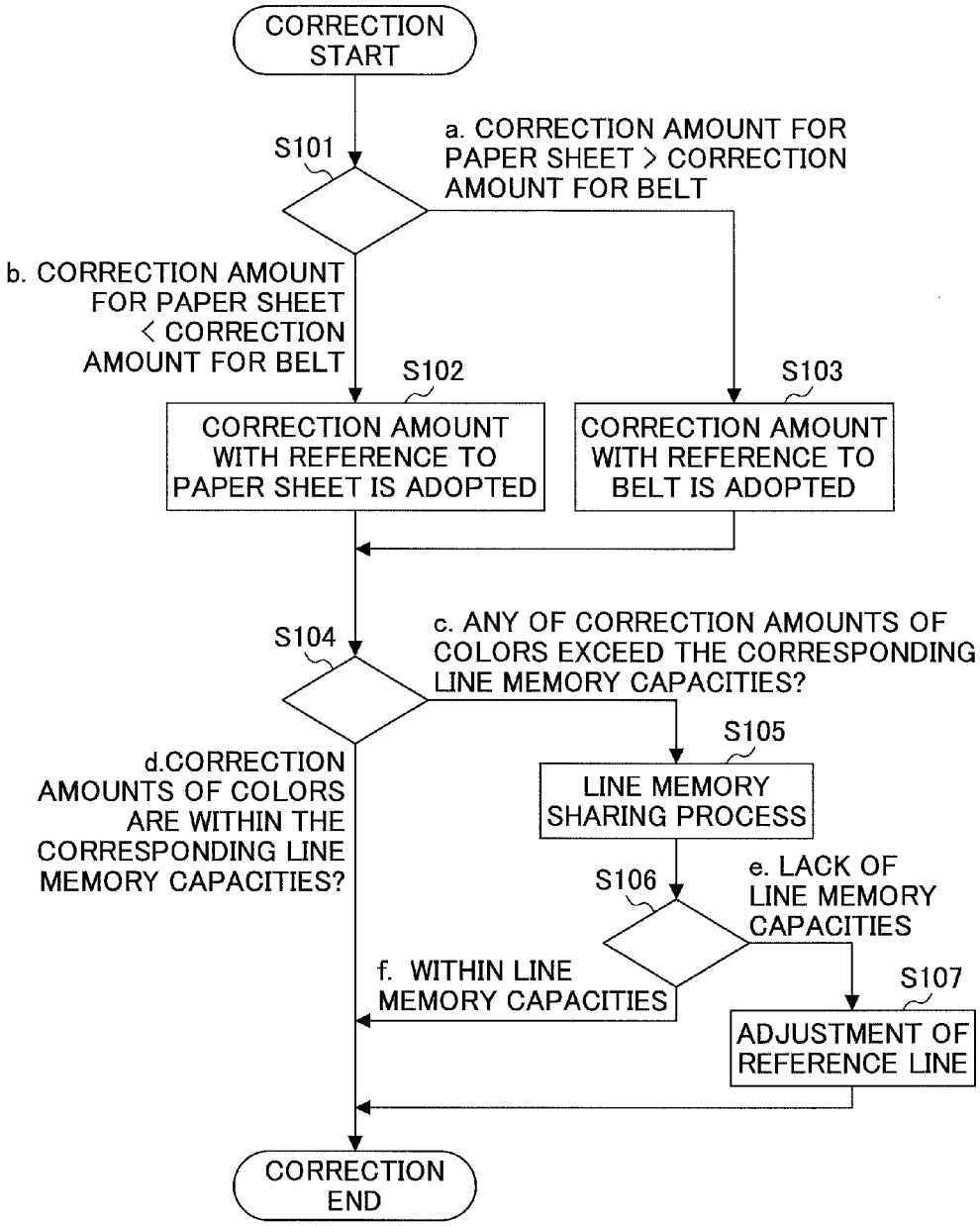
FIG. 6 is a flowchart illustrating an example of a control method including controlling a change of a reference line in the case of performing the skew correction with reduced capacity of the line memory.

FIG. 6 is a flowchart illustrating an example of a control method in the case of performing the skew correction with the reduced capacity of the line memory. As illustrated in FIG. 5, in order to perform the correction control with the reduced capacity of the line memory, the correction method is changed according to a relationship between the belt correction amount and the paper sheet correction amount at the time of calculating these correction amounts. Specifically, when the correction is started, at first, the relationship between the correction amount for the paper sheet 4 and the correction amount for the belt B is determined (step 101). If the correction amount for the paper sheet 4 is smaller than the correction amount for the belt B (branch b), the skew amount Δp of the paper sheet is adopted as a skew correction amount (step 102). On the other hand, if the correction amount for the paper sheet 4 is greater than the correction amount for the belt B (branch a), the belt skew amount ΔB is adopted as a skew correction amount (step 103).

Next, the correction amounts of the respective colors are compared with the line memory capacities (step 104). If the correction amounts of the respective colors are within the corresponding line memory capacities (branch d), the correction process ends. On the other hand, if any of the correction amounts of the respective colors exceed the corresponding line memory capacities (branch c), the line memory sharing process described above with reference to FIG. 5 is performed (step 105). In the line memory sharing process, it is determined whether the correction amounts are within the corresponding line memory capacities (step 106). If the correction amounts of the respective colors are within the corresponding line memory capacities (branch f), the corrections are performed according to the skew correction amount determined in step 102 or 103. If any of the line memory capacities is still insufficient (branch e), the position of the belt reference line BL is adjusted (step 107), because this cannot be addressed by the line memory sharing process. In this case, the correction is not completed yet, and thus the processes from step 101 are repeated until the correction amounts are within the corresponding line memory capacities in step 106.

Specifically, according to this control method, with respect to the black color, for example, at first, the relationship between the correction amount for the paper sheet 4 and the correction amount for the belt B is determined (step 101). If the belt correction amount Kb for the belt B is smaller than the correction amount K for the paper sheet 4 (branch a) and within the corresponding line memory capacity (step 104: branch d), the belt correction amount Kb is adopted as a skew correction amount. To the contrary, if the correction amount K for the paper sheet 4 is smaller than the belt correction amount Kb for the belt B (branch b) and within the corresponding line memory capacity (step 104: branch d), the paper sheet correction amount K is adopted as a skew correction amount. In this way, with the processes 101 through 103, the smaller of the skew amount for the paper sheet 4 and the skew amount for the belt B is selected.

After that, the correction amount is determined on a color basis, and the color whose correction amount is within the corresponding line memory capacity provides free space to be shared with other color such that the correction amount of other color is within the corresponding line memory capacity (step 105). For example, if the correction amount for the black color is smaller than the corresponding line memory capacity and the correction amount for the magenta color is greater than the corresponding line memory capacity, free space of the line memory which is not used for the correction of the black color is used for the correction of the magenta color. In this way, the line memory capacity for the magenta color is increased, thereby enabling the correction.

If the line memory capacity is still not sufficient even after the adjustment of the correction amounts and the sharing process of the line memory have been performed (step 106: branch e), the correction amounts are reduced such that they are within the corresponding line memory capacities (step 107). Specifically, the correction amounts are reduced as follows:

$$\text{Adjusted skew amount } \Delta pc = \Delta p - \text{“correct_step”} \tag{5}$$

$$\text{Correction amount } K = \Delta pc + \Delta K \tag{6}$$

$$\text{Correction amount } M = \Delta pc + \Delta M \tag{7}$$

It is noted that the correction amounts of the equations (6) and (7) indicate the correction amounts for the black color and the magenta color which use the line memory 34, respectively.

Δpc is the adjusted skew amount obtained after having adjusted the line memory capacity, and “correct_step” is a unit of the adjustment. The “correct_step” may be changed according to the correction amount. For example, if the “correct_step” is proportional to the skew amount, it is possible to reduce the number of times repeating the adjustment.

In this example, the calculation of the correction amounts of the black and magenta colors based on the determination of the adjusted skew amount Δpc is repeated until the correction amounts K and M are within the corresponding line memory capacities. In this way, it is possible to perform the skew correction between images while minimizing the skews of the sheet paper and between the images. It is noted that the writing start positions of the respective colors are corrected by the writing start position correction control which is not explained specifically.

Figure 7A:
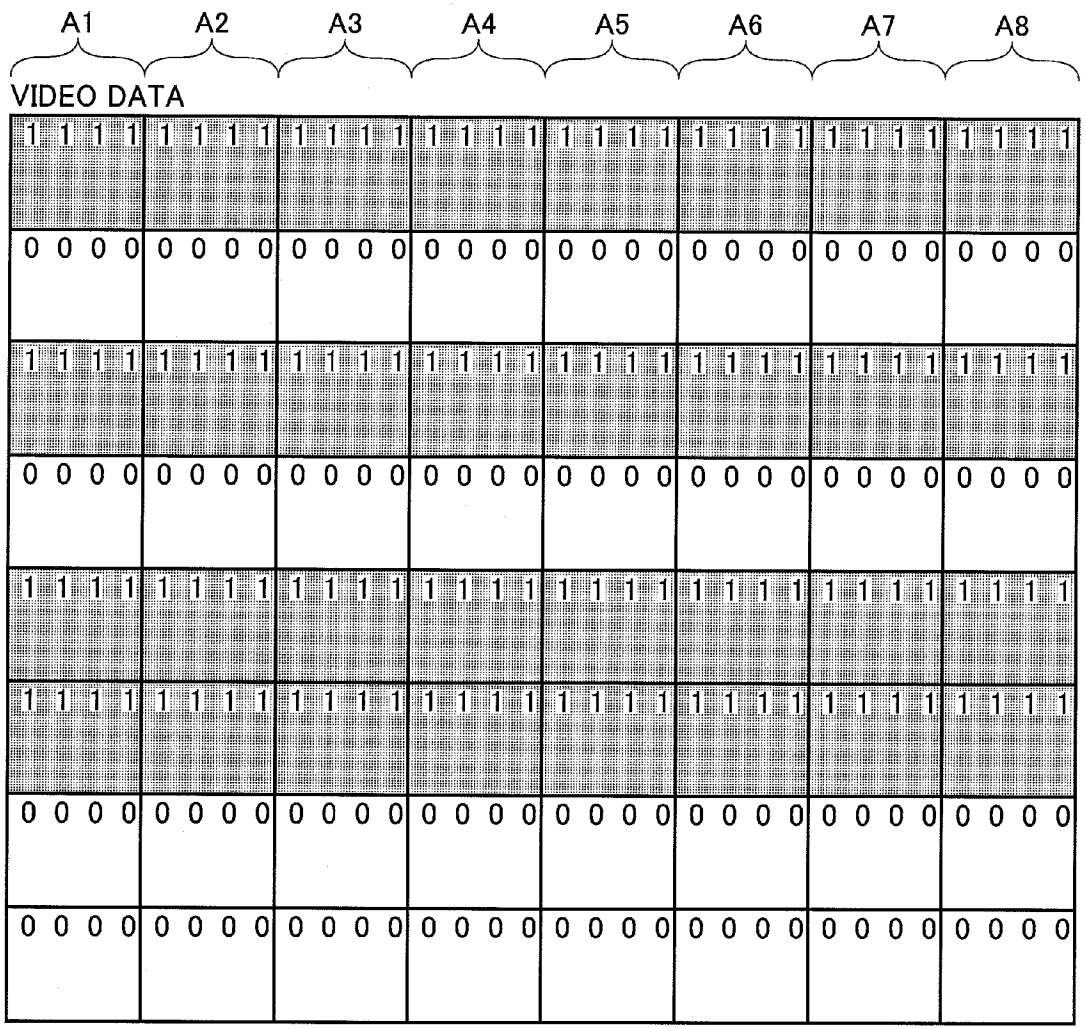
FIGS. 7A and 7B are drawings for explaining an example of line memory control.
Figure 7B:
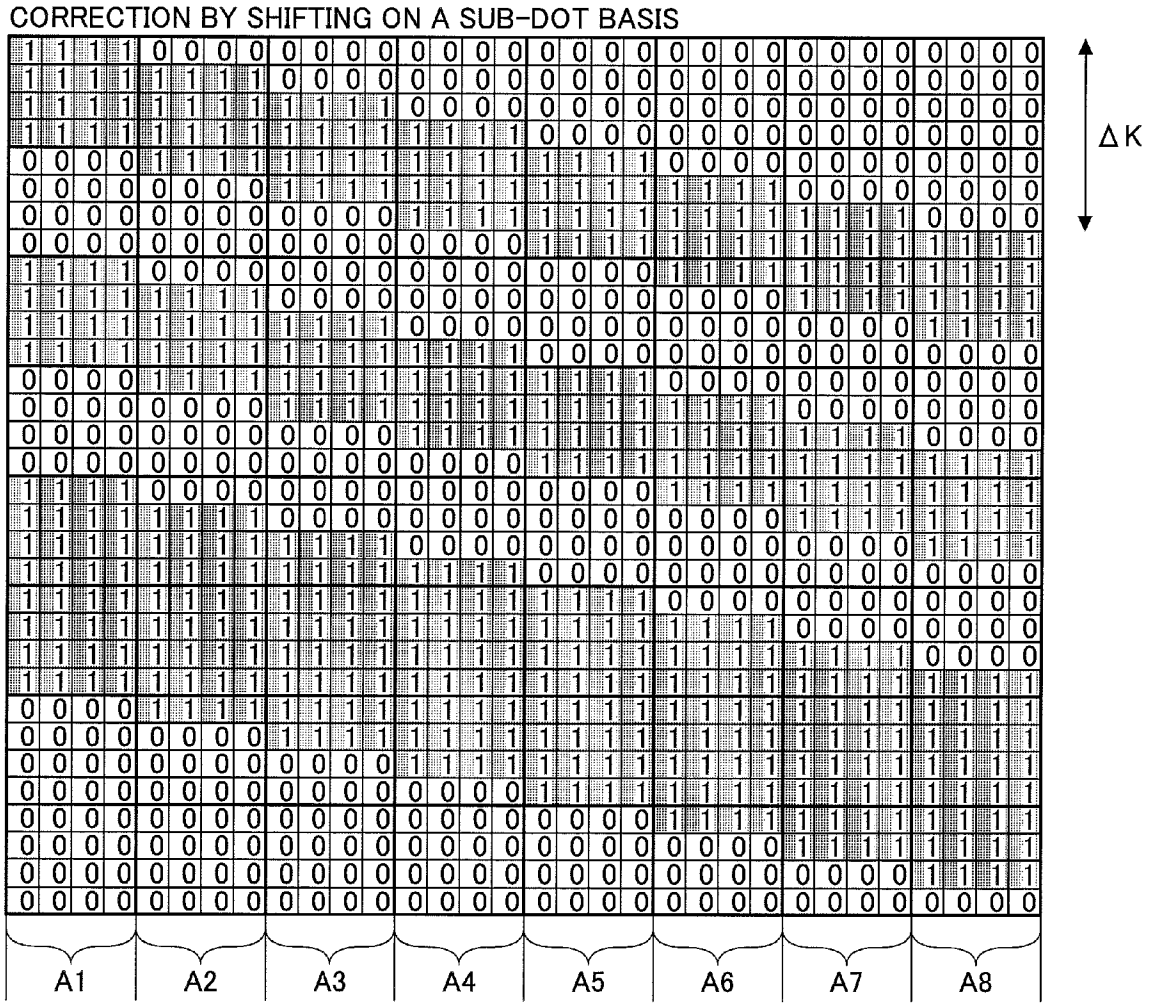

FIGS. 7A and 7B are drawings for explaining an example of line memory control. FIG. 7A illustrates video data to be input, and FIG. 7B illustrates an example of the line memory control for performing the skew correction using the line memory. In FIG. 7A, if binary input image data (video data) is input, plural areas A1 through A8 divided in the main scanning direction are set, and a line delay amount is set on an area (A1 through A8) basis.

In other words, the line memory 34 delays the original video data based on the calculated correction amount K of the black color to perform the skew correction. In the example illustrated in FIG. 7B, since the correction is performed using the left end as a reference, the data at the right end is shifted in a downward direction by ΔK dots corresponding to the amount of the displacement in comparison with the left end. To the contrary, if the right end is shifted in a downward direction with respect to the left end, the data at the left end is delayed by ΔK dots with respect to the right end. At that time, if the amount of the displacement ΔK dots corresponds to a sub-dot which is smaller than or equal to 1 dot, that is to say, if the delay is performed with a resolution smaller than or equal to 1 pixel, it is possible to reduce the degradation of the image due to the skew correction. It is noted that in the example illustrated in FIG. 7B, the sub-dot is a quarter dot.

Figure 8:
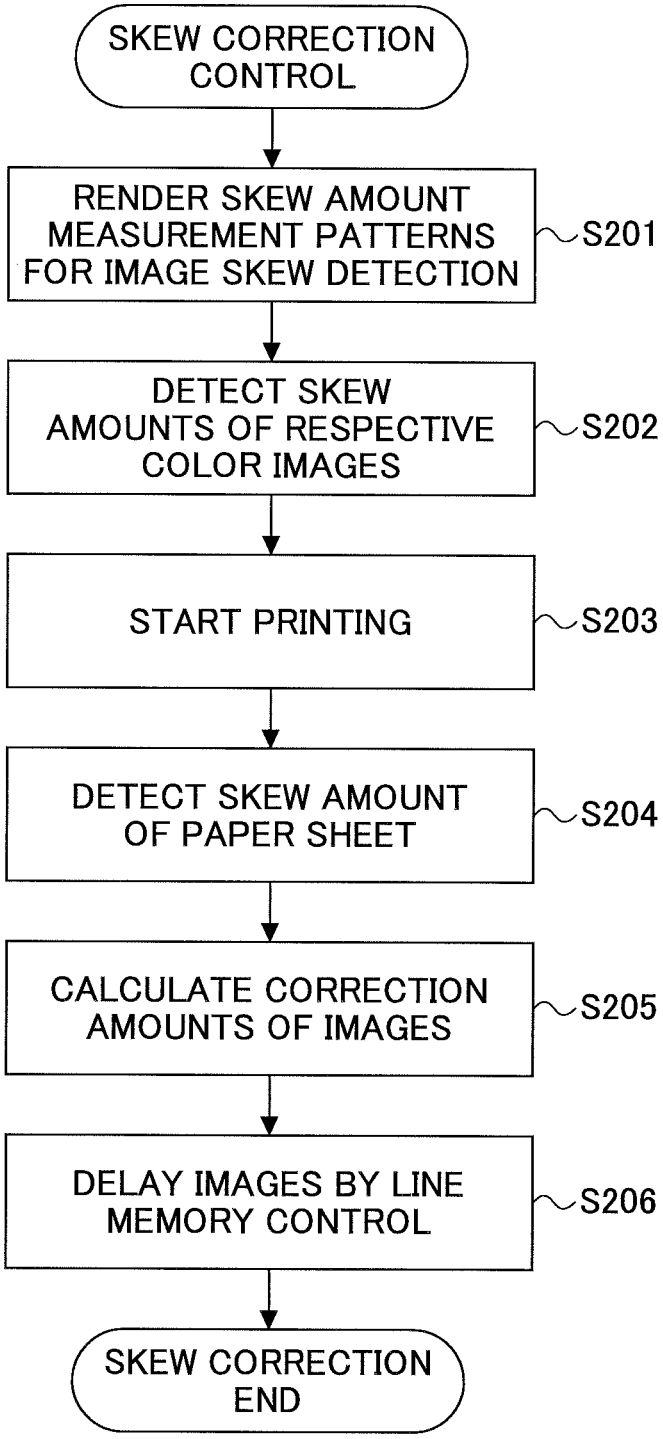
FIG. 8 is a flowchart illustrating an example of a control method of skew correction.

FIG. 8 is a flowchart illustrating an example of a control method of skew correction.

In FIG. 8, according to the skew correction control, at first, skew amount measurement patterns are rendered on the belt B (step 201), and the skew amounts of the images of the respective colors are detected (step 202). The skew amount measurement of the image is performed at regular time intervals or at the time of status changes such as exchanges of consumable items, the movement of the machine, etc. In addition to the mode in which is the patterns are rendered on the belt B, there is a mode in which a pattern for the adjustment is printed on the paper sheet. In this mode, a user evaluates the printed image and adjusts a default value of the skew adjusting amount. This is used to adjust the skew error generated when the reflective sensor is attached.

Next, when the printing is started (step 203), the paper sheet is conveyed by the feeding roller. The skew amount of the paper sheet itself is detected (step 204) by measuring the positions of the opposite ends of the paper sheet when the paper sheet passes the reflective sensors (the sensor 21 in FIG. 1 and sensors 17 and 19 in FIG. 2). After that, the correction amounts of the images are calculated (step 205) and the images are delayed by the line memory control (step 206) to complete the skew correction. The method of delaying is as described with reference to FIG. 7.

It is noted that steps 201 and 202 are processes for forming the skew amount measurement patterns of the images, and steps 203 and 204 are processes for measuring the skew amount of the paper sheet after the printing is started. If the detected skew amount of the paper sheet itself exceeds an abnormality threshold, the fact that there will be abnormality in the printed image is reported to the user, leaving the determination whether to stop the printing to the user. In steps 205 and 206, the correction amounts are calculated based on the detected skew amounts and the images are corrected by the line memory control according to the correction amounts. If the correction amounts exceed the corresponding line memory capacities but the skew amount of the paper sheet is smaller than or equal to an adjustment threshold set separately, this means that the skew of the image is too great with respect to the paper sheet, and thus an abnormality is detected. The information representing the abnormality is displayed in the operating part 29 to be reported to the user.

According to the present embodiment, as described above, in the skew correction control in which the skew amount of the paper sheet is detected, which amount is fed back to the line memory control for the skew correction, the reference line for the skew correction is changed and/or the line memory capacities for the respective colors are changed to perform the skew correction without increasing the overall capacity of the line memory. Therefore, it is possible to reduce the skew displacement amount generated between the image and the paper sheet with the reduced capacity of the line memory (i.e., without increasing the overall capacity of the line memory).

The present invention is disclosed with reference to the preferred embodiments. However, it should be understood that the present invention is not limited to the above-described embodiments, and variations and modifications may be made without departing from the scope of the present invention.

The present application is based on Japanese Priority Application No. 2010-206788, filed on Sep. 15, 2010, the entire contents of which are hereby incorporated by reference.

What is claimed is:

1. An image processing apparatus for a skew correction, comprising:

a reading part configured to optically read skew amount measurement patterns and opposite ends of a paper sheet;

an image skew amount detecting part configured to detect skew amounts of colors on a color basis based on the skew amount measurement patterns read by the reading part;

a paper sheet skew amount detecting part configured to detect a skew amount of the paper sheet based on a displacement between the opposite ends of the paper sheet read by the reading part;

a skew correction amount calculating part configured to calculate skew correction amounts of images of the respective colors based on the skew amounts detected by the image skew amount detecting part and the paper sheet skew amount detecting part; and a skew correcting part configured to shift images to correct the skews by recording input image data in plural lines of a line memory, dividing the input image data into plural areas in a main scanning direction, and setting line delay amounts on an area basis based on the skew correction amounts calculated by the skew correction amount calculating part;

wherein the skew correcting part includes:

multiplexers provided for each line of the line memory; and a controlling part configured to determine, based on data amounts of the respective colors of the input image data, a sharing amount of the line memory and generates control signals of the multiplexers based on the determined sharing amount such that when one of images of the respective colors has the skew correction amount greater than a corresponding line memory capacity allocated to the one image of the color, free space of the line memory, which is initially allocated to another image, is used to perform the skew correction for the one image.

2. The image processing apparatus as claimed in claim 1, wherein when the free space cannot be used for the skew correction for the one image, the skew correcting part detects a skew amount of the paper sheet and a skew amount of a belt to calculate a reference line with respect to the paper sheet and another reference line with respect to the belt, and select one of the reference lines of which the skew correction amount is within the capacity of the line memory.

3. The image processing apparatus as claimed in claim 2, wherein the selection is performed by repeating setting of an adjustment amount and calculation of the reference line with respect to the paper sheet and the reference line with respect to the belt such that the skew correction amounts are within the capacity of the line memory.

4. The image processing apparatus as claimed in claim 3, wherein the adjustment amount is changed such that it is proportional to the skew correction amounts.

5. The image processing apparatus as claimed in claim 3, wherein the adjustment amount is smaller than or equal to one pixel.

6. The image processing apparatus as claimed in claim 1, wherein when the skew correction amounts calculated by the skew correction amount calculating part are greater than the capacity of the line memory but a skew amount of the paper sheet is smaller than or equal to a paper sheet skew upper limit threshold, an abnormality of the images is detected.

7. The image processing apparatus as claimed in claim 6, further comprising an abnormality reporting part configured to report to an operator that the abnormality is detected.

8. An image forming apparatus including the image processing apparatus as claimed in claim 1.

9. The image forming apparatus as claimed in claim 8, further comprising:

a conveyer belt;

plural image forming parts for the respective colors which are arranged along the conveyer belt and configured to form a multi-colored image by transferring images of the respective colors to a paper sheet on a one-by-one basis when the paper sheet passes the image forming parts for the respective colors while it is held on the conveyer belt; and the paper sheet skew amount detecting part provided above the conveyer belt, wherein a sensor is shared between the paper sheet skew amount detecting part and the image skew amount detecting part.

10. The image forming apparatus as claimed in claim 8, further comprising:

an intermediate transfer belt;

plural image forming parts for the respective colors which are arranged along the intermediate transfer belt and configured to form a multi-colored image by transferring images of the respective colors, which are transferred to the intermediate transfer belt on a one-by-one basis when the intermediate transfer belt passes the image forming parts for the respective colors, to a paper sheet at one action; and the paper sheet skew amount detecting part provided at a location where a conveying path of the paper sheet and the intermediate transfer belt are overlapped.

* * * * *